US006323825B1

(12) United States Patent
Zidek et al.

(10) Patent No.: US 6,323,825 B1
(45) Date of Patent: Nov. 27, 2001

(54) REACTIVELY COMPENSATED MULTI-FREQUENCY RADOME AND METHOD FOR FABRICATING SAME

(75) Inventors: Paul A. Zidek, Lafayette; Farzin Lalezari, Louisville, both of CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/626,579

(22) Filed: Jul. 27, 2000

(51) Int. Cl.[7] ..... H01Q 19/06

(52) U.S. Cl. ..... 343/872; 343/909; 343/753

(58) Field of Search ..... 343/872, 909, 343/753, 755, 756; 29/600; H01Q 19/14, 19/06

(56) References Cited

U.S. PATENT DOCUMENTS

| | | | | |
|---|---|---|---|---|
| 3,148,370 | | 9/1964 | Bowman | 343/756 |
| 4,342,035 | | 7/1982 | Anderson et al. | 343/792.5 |
| 4,656,487 | | 4/1987 | Sureau et al. | 343/909 |
| 4,743,919 | | 5/1988 | Chang et al. | 343/914 |
| 4,812,853 | | 3/1989 | Negev | 343/700 |
| 4,814,785 | | 3/1989 | Wu | 343/909 |
| 4,905,014 | | 2/1990 | Gonzalez et al. | 343/909 |
| 4,970,634 | | 11/1990 | Howell et al. | 362/342 |
| 5,140,338 | * | 8/1992 | Schmier et al. | 343/909 |
| 5,162,809 | | 11/1992 | Wu | 343/909 |
| 5,208,603 | | 5/1993 | Yee | 343/909 |
| 5,311,202 | | 5/1994 | Popp et al. | 343/909 |
| 5,384,575 | | 1/1995 | Wu | 343/909 |
| 5,400,043 | * | 3/1995 | Arceneaux et al. | 343/872 |
| 5,455,594 | | 10/1995 | Blasing et al. | 343/700 |
| 5,528,249 | * | 6/1996 | Gafford et al. | 343/704 |
| 5,543,815 | | 8/1996 | Wu et al. | 343/909 |
| 5,563,614 | | 10/1996 | Alden et al. | 343/701 |
| 5,579,024 | | 11/1996 | Sureau | 343/909 |
| 5,592,186 | | 1/1997 | Hoofe, IV et al. | 343/909 |
| 5,600,325 | * | 2/1997 | Whelan et al. | 343/909 |
| 5,652,631 | * | 7/1997 | Bullen et al. | 343/872 |

* cited by examiner

*Primary Examiner*—Hoanganh Le
(74) *Attorney, Agent, or Firm*—Sheridan Ross P.C.

(57) ABSTRACT

A multi-frequency radome includes a material-tuned radome portion for generating a low frequency passband of the radome and an integrated low pass frequency selective surface (FSS) portion for tuning a high frequency passband of the radome. The FSS portion provides a reactance necessary to move an upper passband of the material-tuned radome to a desired spectral location. Because the FSS portion is a low pass structure relative to the low frequency passband of the material-tuned radome portion, it does not substantially affect the low frequency passband when the FSS portion is applied to the material-tuned radome. In one embodiment, the FSS portion is designed to take advantage of various well known properties of FSS structures, such as the ability to tune for angle of arrival and polarization properties.

28 Claims, 5 Drawing Sheets

Low Pass
Frequency Selective Surface

REACTIVELY COMPENSATED MULTI-FREQUENCY RADOME AND METHOD FOR FABRICATING SAME

FIELD OF THE INVENTION

The invention relates in general to antenna radomes and, more particularly, to radomes having multiple frequency passbands.

BACKGROUND OF THE INVENTION

A radome is a structure that is used to shelter and protect an underlying antenna from a surrounding environment. A radome may be used, for example, to protect an antenna from high winds, icing, and/or temperature extremes in an area surrounding the antenna. Radomes generally comprise a rigid or semi-rigid structure that partially or fully envelopes the antenna and are thus, at least partially, within the signal flow path of the antenna. For this reason, radomes are normally designed to have relatively low transmission loss (i.e., to be transparent) within the operational frequency range of the antenna. If a radome is to be used in connection with a multi-frequency antenna (i.e., an antenna operative in two or more distinct frequency bands) , then the radome should be transparent in multiple frequency bands. As can be appreciated, design of such multi-frequency radomes can be difficult.

One type of radome structure, known as a material-tuned randome, utilizes one or more layers of dielectric material to achieve a desired frequency response. That is, one or more dielectric layers, each having a predetermined thickness and dielectric constant, are stacked in a manner that synthesizes a desired frequency response. Design techniques for achieving a material-tuned radome having a relatively low loss "passband" within the operational frequency range of an antenna are well known in the art. In addition, material-tuned radome design techniques for achieving multiple passbands for use in connection with, for example, multi-frequency antenna systems are also known. Multi-frequency material-tuned radomes are relatively complex structures that normally include a large number of dielectric layers. To achieve a desired frequency response, the thickness of the various dielectric layers of the multi-frequency radome (deposited during radome fabrication) must be relatively precise. At higher frequencies, however, dimensional control of these layers becomes difficult, thus complicating the multi-frequency radome fabrication process.

Even greater difficulty is encountered when it is necessary to add a new, higher frequency passband to an already existing material-tuned radome design. This may be necessary, for example, if a new antenna that is operative in a different frequency range is being added to a corresponding antenna system. If the existing radome is not transparent in the new frequency band, then the radome must either be modified to add a new passband or the radome must be replaced with a new multi-frequency design. As can be appreciated, it is preferable that the old radome be modified to avoid the costs associated with the design and development of a new radome. However, such modifications can be complicated and are sometimes just as costly as a redesign. Therefore, there is a need for a multi-frequency radome structure that is relatively simple and inexpensive to design and fabricate. There is also a need for a method and apparatus for adding one or more additional passbands to an existing radome structure without negatively affecting an already existing passband. In addition, there is a need for a method and apparatus for modifying a material-tuned radome to achieve a desired multi-frequency response without the need for additional dielectric layers.

SUMMARY OF THE INVENTION

In accordance with the present invention, a method is provided for forming a radome or dielectric so that its center frequency value is changed. Such a structure being formed can be an originally manufactured unit or it can be a retrofitted unit. The radome or dielectric structure can be a monolithic or a multi-layered structure. The structure has a transmission frequency response including a resonance region with a center frequency at a first frequency value. The center frequency can be changed from this first frequency value to different or second frequency value. In one embodiment, the transmission frequency response has first and second resonance regions. The first and second resonance regions have center frequencies of first and second frequency values, respectively. The second frequency value can be changed to a third frequency value.

With regard to shifting or changing the center frequency, a conductive surface is provided on the radome or dielectric structure. The conductive surface can be a periodic conductive pattern or frequency selective surface. In providing the frequency selective surface, the metallic layer can be formed on a surface of the radome structure and the metallic layer etched to form a periodic metallic pattern on the surface. Before the frequency selective surface is disposed on the radome or dielectric structure, a determination is made regarding the configuration of the frequency selective surface pattern that will provide a necessary impedance, such as reactance, to the radome or dielectric structure to shift the center frequency of the particular resonance region. In determining the pattern configuration, a mathematical calculation using the method of moments can be utilized. Depending on the number of resonance regions having center frequencies, the frequency selective service can be a low pass filter structure having a cutoff frequency that can be greater than the frequency value or values of the center frequencies associated with the one or more resonance regions.

Based on the foregoing summary, a number of salient benefits of the present invention are immediately recognized. A radome or dielectric structure can be provided in which the frequency value of a center frequency can be suitably shifted. This has desired utility in retrofitting a radome when it is necessary or appropriate to modify an existing radome to achieve another higher frequency passband associated with the radome. The present method is readily implemented to provide an acceptable performing dielectric structure that has the required passband.

Additional advantages of the present invention will become readily apparent from the following discussion, particularly when taken together with the accompanying drawing figures.

DETAILED DESCRIPTION

The present invention relates to a reactively compensated multi-frequency radome. The radome includes a material-tuned portion for achieving at least one lower frequency passband and an integrated frequency selective surface (FSS) portion for achieving a desired higher frequency passband. The FSS portion is used as a reactive tuning element to move an already existing upper passband of the material-tuned radome portion from an original spectral location to a desired spectral location. In addition, the FSS portion is a low pass filter structure that does not substantially affect the original low frequency passband of the material-tuned radome portion, which remains largely unchanged. The principles of the present invention can be used to manufacture new multi-frequency radomes or to retrofit already existing radomes to operate in a new frequency band. In the following discussion, the principles of the present invention are described in the context of an airborne antenna system located in the nosecone of an aircraft. It should be appreciated, however, that the inventive principles can be used in connection with any type of antenna system that uses a radome, including both mobile and stationary systems.

Figure 1:
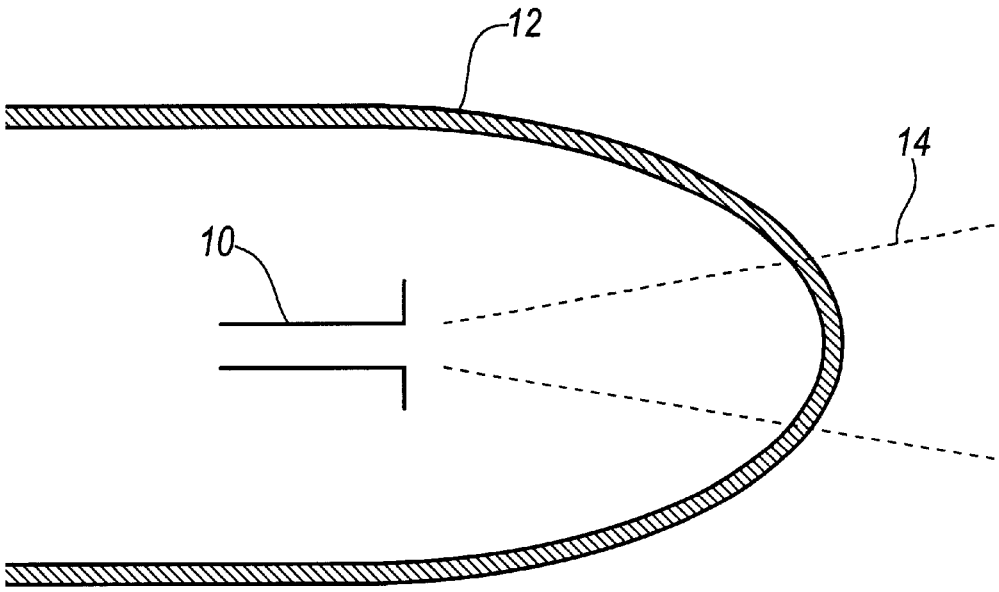
FIG. 1 is a sectional side view of the nosecone of an aircraft which acts as a radome for an antenna located within the radome.

FIG. 1 is a simplified sectional side view of an aircraft nosecone that also operates as a radome 12 for an antenna 10 located within the nosecone. The antenna 10 can be used, for example, as part of a weather radar system utilized by the aircraft to detect potentially dangerous weather patterns in the flight path of the aircraft. The antenna 10 generates an antenna beam 14 which radiates through a portion of the radome 12. During normal operation, the antenna 10 transmits and receives signals in a predetermined operational frequency range to/from an exterior environment through the radome 12. Received signals are processed within the aircraft using on-board signal processing functionality.

Because the antenna 10 communicates through the radome 12, it is desirable that the radome 12 introduce as little signal attenuation (e.g., reflection loss) as possible in the operational frequency band of the antenna 10. Thus, the radome 12 is generally designed so that an attenuation minimum is achieved in the frequency response of the radome 12 at or near the center frequency of the frequency band of interest. In the past, radome design often involved the selection of one or more layers of dielectric material to achieve a desired passband, using a structure known as a material-tuned radome. In its simplest form, known as monolithic radome, the material-tuned radome includes a single layer of dielectric material having a thickness equal to one-half wavelength (or a multiple thereof) at the center frequency of the antenna 10. In a more complex approach, multiple layers are used to provide additional degrees of design freedom to achieve, for example, a wider operable bandwidth or a larger range of acceptable incidence angles. Outside of the passband, the material-tuned radome presents a greater amount of signal attenuation to a propagating signal. This increased signal attenuation can be advantageously used to perform functions such as EMI rejection or radar cross section reduction.

Figure 2:
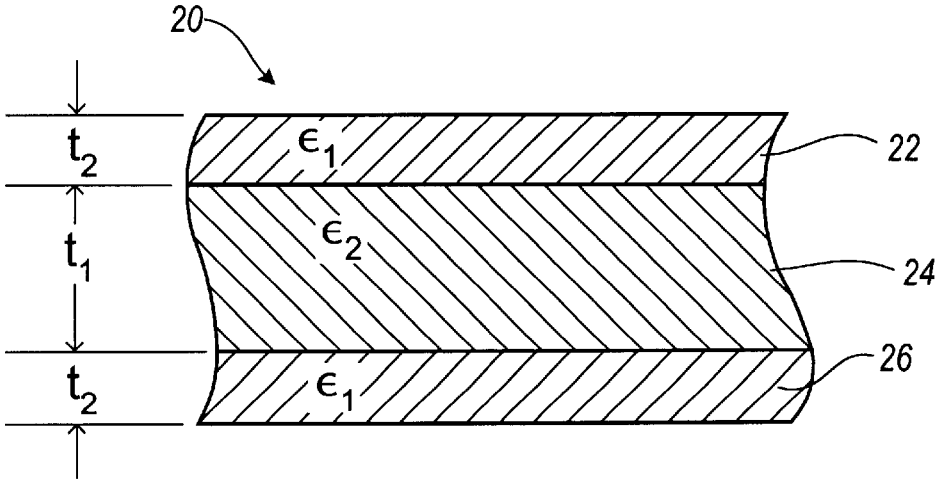
FIG. 2 is a sectional side view illustrating a multi-layer material-tuned radome structure that can be modified in accordance with the present invention.

FIG. 2 is a cross-sectional side view of a material-tuned radome 20 having three layers of dielectric material 22, 24, 26 forming a structure known as an A-sandwich. The radome 20 includes a center core layer 24 having a thickness $t_1$, equal to approximately one quarter wavelength at the center frequency of the antenna and two outer layers 22, 26 each having a thickness $t_2$ that is considerably less than the thickness of the core layer 24. The core layer 24 utilizes a material having a relatively low dielectric constant $\in_2$ (e.g., $\in_2$=1.2) compared to the dielectric constant $\in_1$ (e.g., $\in_1$=4) of the material of the outer layers 22,26. In general, the A-sandwich configuration is capable of greater passband bandwidths than the monolithic radome structure and is therefore commonly used. Other multi-layer structures, such as the well known B-sandwich and C-sandwich structures, also exist.

Figure 3:
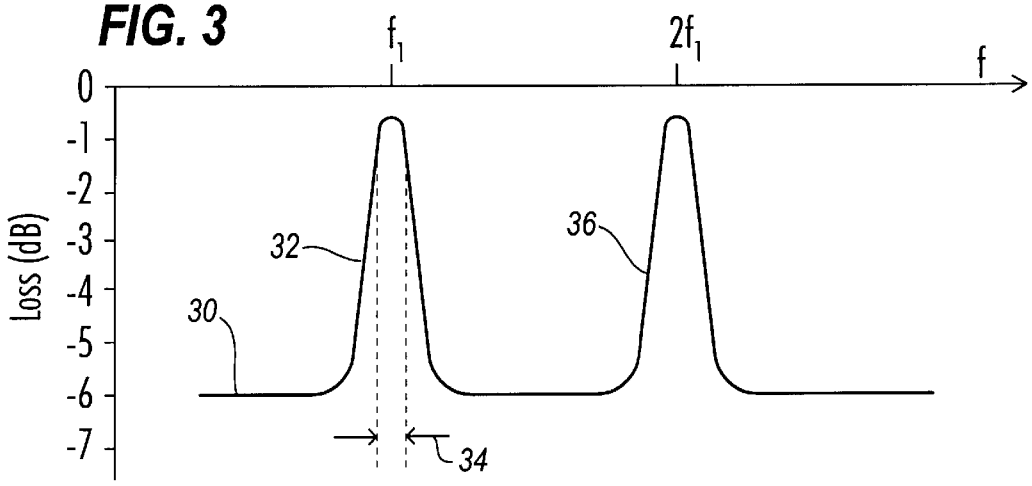
FIG. 3 is a graph illustrating a simplified transmission frequency response for the material-tuned radome illustrated in FIG. 2.

FIG. 3 is a graph illustrating a possible transmission frequency response 30 for the radome 20 of FIG. 2. As shown, the frequency response 30 includes a primary resonance 32 having a passband 34 approximately centered about the center frequency $f_1$ of a corresponding antenna. The frequency response 30 also includes an upper (e.g., harmonic) resonance 36 located at twice the center frequency $f_1$ of the antenna (i.e., 2 $f_1$). Although not shown, the frequency response 30 also includes additional higher frequency resonances. The higher frequency resonances result from the fact that the dimensions of the radome layers are based on predetermined fractions of a wavelength. Therefore, the radome behaves similarly at multiples of the primary frequency.

Figure 4:
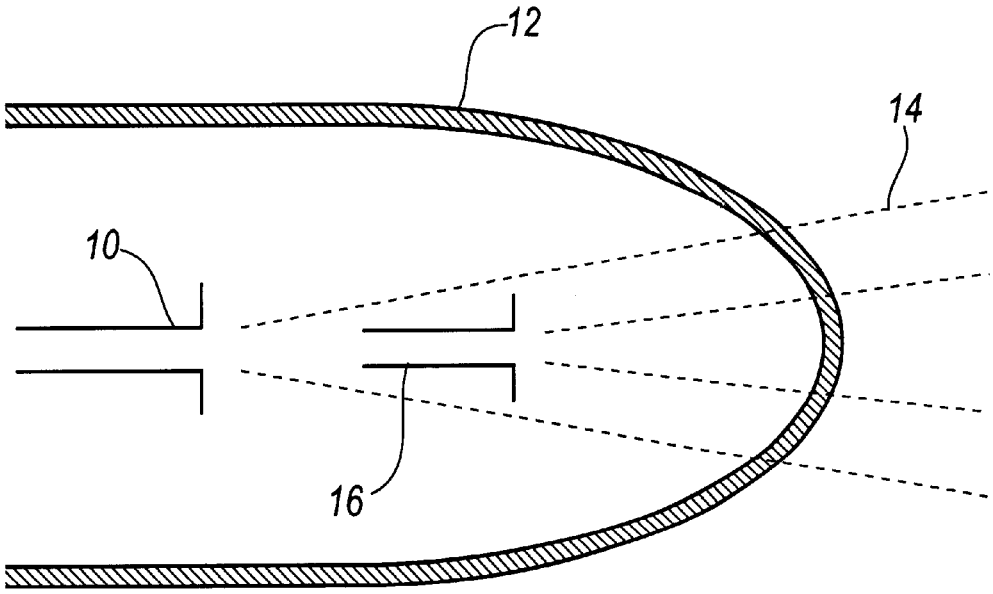
FIG. 4 is a sectional side view of the nosecone of an aircraft which acts as a radome for multiple antennas located within the radome.

After the antenna arrangement of FIG. 1 has been in service for a period of time, it may become necessary to add a second antenna to the nosecone area of the aircraft. The second antenna may be needed to perform a function different from that of the first antenna such as, for example, a communications function or an identify friend or foe (IFF) application. In this regard, the second antenna will generally be operative in a second frequency range that is different from the operational frequency range of the first antenna 10. FIG. 4 illustrates the nosecone of FIG. 1 with a second antenna 16 added to the first antenna 10. As can be appreciated, it is desirable that the radome 12 be relatively transparent in the operational frequency range of the second antenna 16 as it is in the operational frequency range of the first antenna 10. However, the radome 12 has been designed to operate with the first antenna 10 and, unless the second antenna 16 operates at a harmonic of the first antenna 10, will generally have a relatively large reflection loss in the frequency range of the second antenna 16. One prior art method of dealing with this problem was to add further dielectric layers to the radome 12 that would, in conjunction with the original layers, reduce the reflection loss in the second frequency range. However, design procedures for doing this are difficult and the reduced dimensional control of the dielectric layer thickness at higher frequencies during fabrication often result in radome structures having degraded performance characteristics in both frequency ranges. Therefore, total radome redesigns are often undertaken to provide the new passband.

In conceiving of the present invention, it was determined that a new radome passband in the frequency range of the second antenna could be achieved by modifying an already existing higher frequency passband of the original radome using reactive tuning. That is, a reactive treatment can be applied to the original radome in a manner that moves the higher frequency passband to a desired spectral location without significantly affecting the existing passband. In a preferred embodiment, the invention utilizes a low pass, frequency selective surface (FSS) structure as a tuning element to provide the reactance necessary to appropriately modify the higher frequency passband. The FSS is applied to either an inside or an outside surface of the radome (or both surfaces) using well known deposition techniques. Because the FSS is a low pass structure, it can be designed to be relatively transparent in the first frequency range so that the original radome passband is left substantially unaffected. That is, the cutoff frequency of the low pass FSS can be chosen to be greater than the upper band edge of the frequency range of the first antenna 10.

As is well known in the art, an FSS is a conductive surface pattern that displays a filter-like frequency response to electromagnetic signals impinging upon the surface. That is, the particular pattern of the FSS will reflect certain frequencies while other frequencies will pass through the FSS with little attenuation. Because FSSs are reliable and relatively easy to design, they are widely used as filters in radio frequency systems. In the present invention, however, FSS structures are used as reactive tuning elements instead of as filters. That is, the particular pattern selected for implementation is chosen because of the effect it has on the overall impedance of the radome structure rather than its inherent filtration capabilities. Normally, "bandpass" FSS structures are used in radome designs to allow a certain range of frequencies to pass through the radome while frequencies outside of the range are reflected. The invention, on the other hand, uses a low pass FSS structure to tune a higher frequency passband of the underlying radome without significantly affecting the original lower frequency passband of the radome. Thus, the cutoff frequency of the lowpass FSS will be greater than the center frequency of the lower frequency passband of the material-tuned radome and either higher or lower than the center frequency of the secondary passband of the material-tuned radome depending on the direction and magnitude of the required frequency shift.

Figure 5:
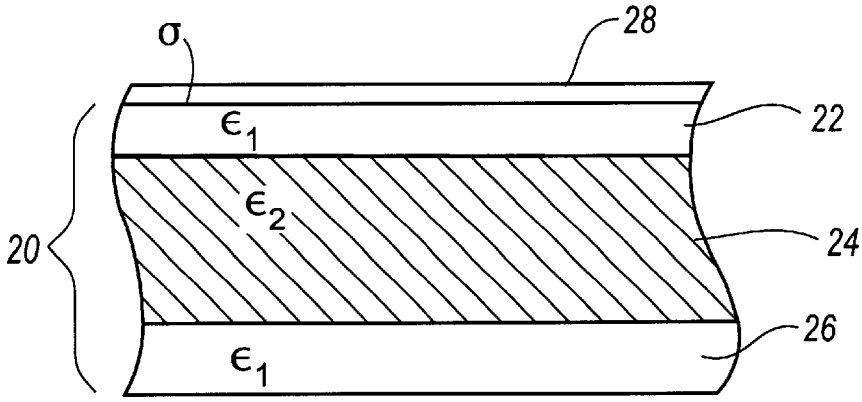
FIGS. 5 and 6 are sectional side views illustrating multi-layer material-tuned radome structures having one or more FSS structures deposited thereon in accordance with the present invention.
Figure 6:
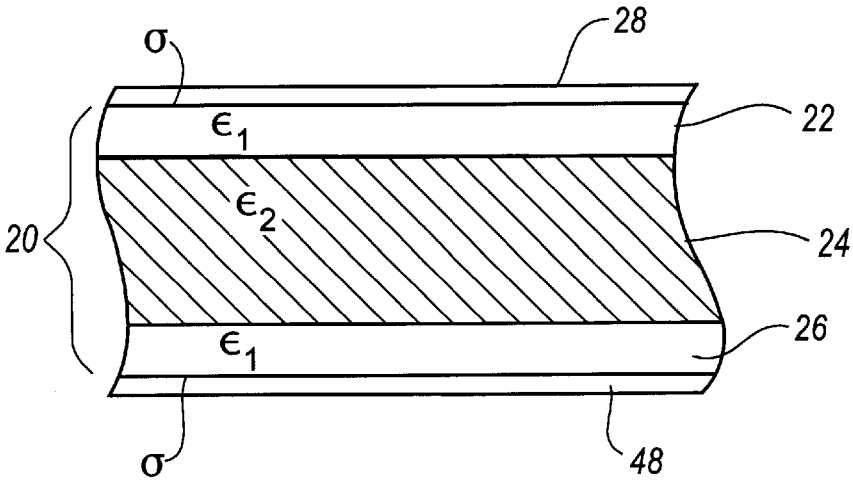

FIG. 5 is a sectional side view illustrating an FSS 28 deposited upon an upper surface of the-material-tuned radome 20 of FIG. 2 in accordance with one embodiment of the present invention. The FSS 28 can be deposited upon either an inside surface or an outside surface of the material-tuned radome 20. Alternatively, as illustrated in FIG. 6, an FSS 28, 48 can be deposited on both sides of the material-tuned radome 20 to achieve an additional level of tuning. Embodiments where an FSS is embedded between dielectric layers are also possible. Techniques for adhering/depositing an FSS to a dielectric are well known in the art.

Figure 7:
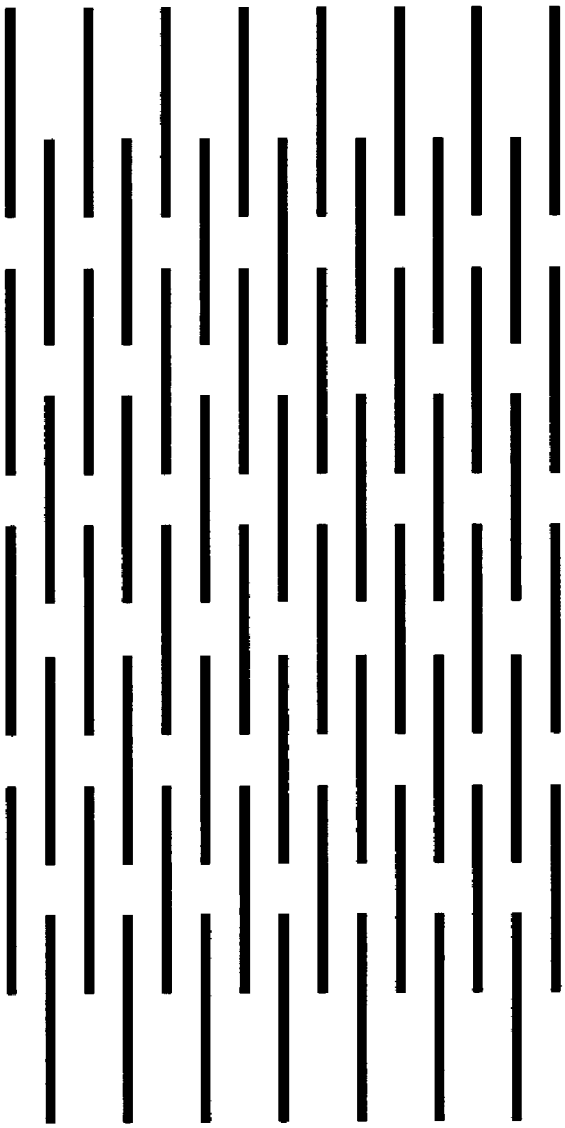
FIG. 7 illustrates a low pass frequency selective surface (FSS) pattern that can be used to tune a material-tuned radome in accordance with one embodiment of the present invention.

FIG. 7 is a top view illustrating a low pass FSS pattern that can be used in accordance with the present invention. The black portions of the pattern represent conductive material while the white portions represent slots or apertures in the conductive material. Because the individual elements of the pattern are relatively small, they are practically invisible in the frequency range of the lower passband. However, as frequencies increase, the elements introduce a reactive term to the overall radome impedance which can be varied as a tuning element. It should be appreciated that the invention can use virtually any low pass FSS pattern that is capable of providing a necessary reactance value and is not limited to the type of low pass FSS pattern illustrated in FIG. 7.

Figure 8:
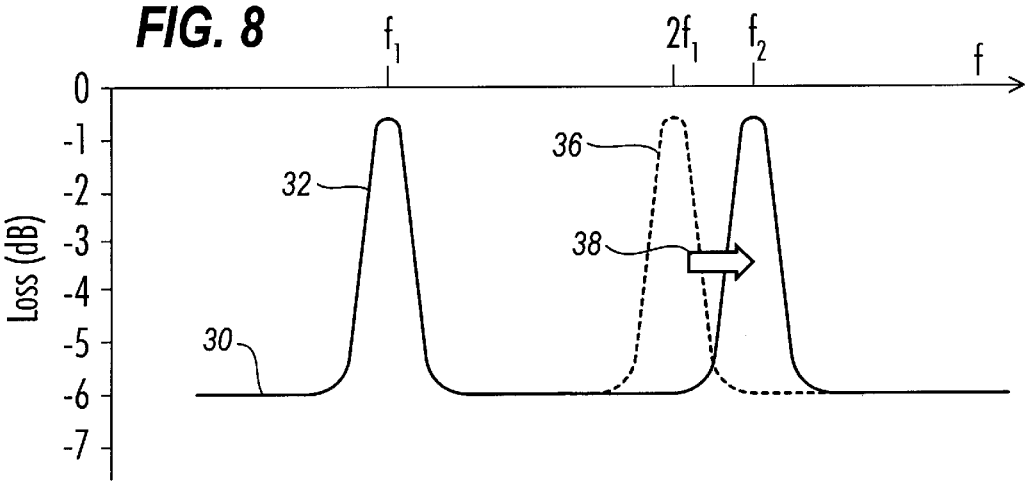
FIGS. 8 and 9 are graphs illustrating modifications to the simplified transmission frequency response of FIG. 3 that can be achieved in accordance with the present invention.
Figure 9:
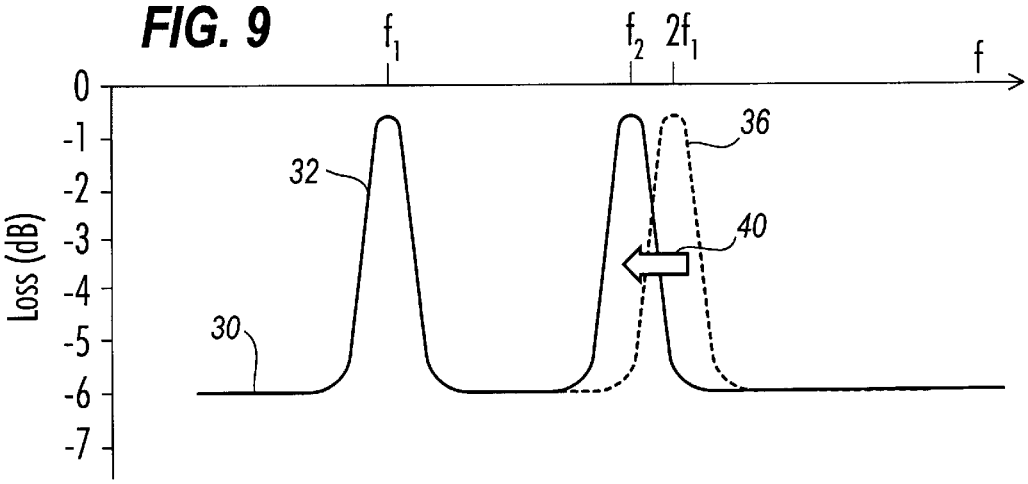

FIGS. 8 and 9 are graphs illustrating modifications 38, 40 to the transmission frequency response 30 of FIG. 3 that can be achieved using the principles of the present invention. As illustrated in FIG. 8, for example, the upper resonance 36 of the material-tuned radome is moved upward in frequency from a position centered at twice the frequency $f_1$ of the primary resonance 32 to a position at or near the center frequency $f_2$ of the second antenna 16. Alternatively, as illustrated in FIG. 9, the upper resonance 36 can be moved downward in frequency if the center frequency $f_2$ of the second antenna 16 is lower than the original frequency of the secondary or upper resonance 36. Significantly, the modifications 38, 40 illustrated in FIGS. 8 and 9 are not limited to use with the secondary resonance 36 of the material-tuned radome. That is, reactive tuning can be used to modify a third, fourth, or even higher resonance in accordance with the present invention. In general, the magnitude of the frequency shift of the higher order resonance will be limited based on the particular design of the original material-tuned radome and available FSS structures.

Figure 10:
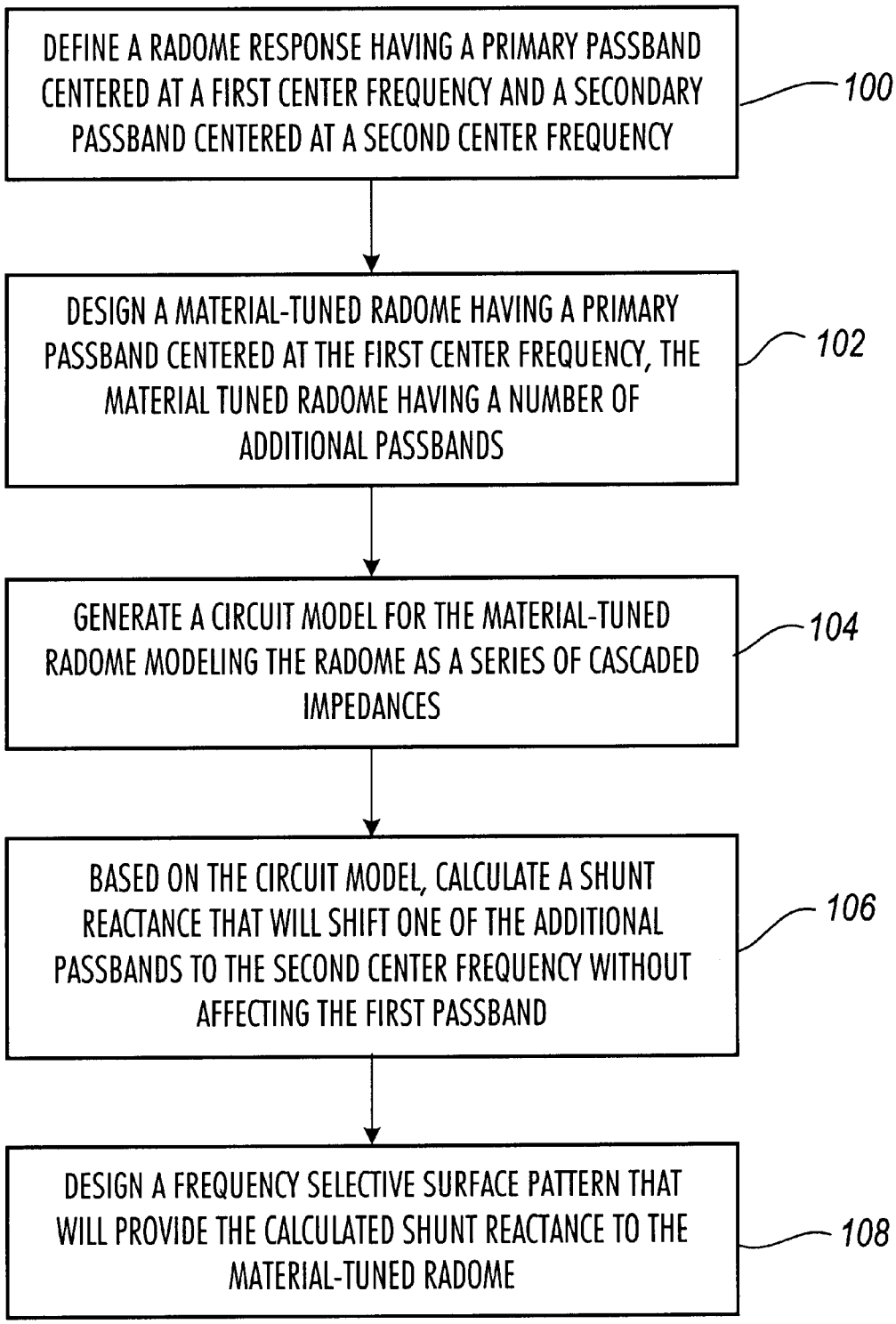
FIG. 10 is a flowchart illustrating a method for tuning a material-tuned radome structure in accordance with one embodiment of the present invention.

FIG. 10 is a flowchart illustrating a method for designing an FSS pattern for use in tuning a material-tuned radome in accordance with one embodiment of the present invention. First, a desired radome response is defined that includes a primary passband centered at a first center frequency and a secondary passband centered at a second center frequency (step 100). A material-tuned radome is then designed that has a primary passband centered at the first center frequency (step 102). In a retro-fit scenario, the material-tuned radome will already be designed. The material-tuned radome will have a number of upper passbands that are inherent in the structure of the radome and can include a monolithic structure or a multi-layer structure such as an A-sandwich, a B-sandwich, or a C-sandwich.

A circuit model of the material-tuned radome is generated which models the material-tuned radome as a series of cascaded impedances that will be seen by an electromagnetic wave propagating through the radome (step 104). Using the model, a shunt reactance is calculated that will shift one of the upper passbands of the material-tuned radome from its current center frequency to the second center frequency (step 106). This is essentially the equivalent of adding a pole to the transfer function of the radome. An FSS pattern is next designed that will provide the calculated reactance when disposed upon the material-tuned radome (step 108). The FSS, however, is chosen to have minimal impact on circuit impedance within the primary passband of the material-tuned radome. Methods for determining such a pattern are well known in the art.

It should be appreciated that, in practice, some or all of the steps of the method of FIG. 10 will be performed using a digital processor executing appropriate software. For example, various programs utilizing the moment method (e.g., employing Floquet modes) can be used to perform the required analysis. One such program, named PMM for "Periodic Moment Method", has been developed by Ohio State University under contract with the United States government. Software can be used to synthesize an FSS having the desired characteristics or, alternatively, an empirical design approach can be implemented and checked using software based analysis. In an alternative to the impedance based design approach, an approach based on the changing dielectric constant of the dielectric layers can be used. That is, a FSS pattern is sought that will change the effective dielectric constant (and, therefore the electrical length) of the dielectric layers of the radome in such a way that moves the secondary resonance of the radome to the desired spectral location. This is possible because the FSS changes the effective dielectric constant of the layers in a frequency dependent fashion, producing a relatively large change at higher frequencies and relatively little change in the vicinity of the first center frequency.

In addition to the tuning effects of the FSS described above, a number of well known properties of FSS structures can be taken advantage of in accordance with the present invention. These properties are unavailable when using additional material layers to achieve desired high frequency passbands. For example, a FSS pattern can be selected in accordance with the present invention to more readily accommodate varying angles of incidence of an incoming electromagnetic wave (such as by implementing a modulated, tapered pattern). Similarly, a FSS pattern can be developed to exhibit specific polarization sensitive properties to maximize cross-polarization rejection. Also, the FSS pattern can be optimized to provide reduced side lobe levels and/or boresight error slope for the underlying antenna system. Other FSS properties can also be advantageously used in accordance with the invention.

In the above discussion, the inventive principles have been described predominantly in the context of a retrofit procedure for an already existing radome. It should be appreciated, however, that the inventive principles can also be used in the design and manufacture of new radomes. That is, a radome can be designed having a material-tuned portion for generating a low frequency passband and a lowpass FSS portion for tuning a high frequency passband. The inventive principles can be used in connection with virtually any type of antenna system, whether ground-based, airborne, or space-based. In addition, the tuning can be performed on any type of material-tuned radome structure, including both monolithic structures (half-wave and full wave) and multi-layer structures (e.g., A, B, and C-sandwich).

Although the present invention has been described in conjunction with its preferred embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. A method for tuning a radome comprising the steps of:

providing a radome structure having at least one layer of dielectric material, said radome structure having a transmission frequency response that describes, as a function of frequency, a level of attenuation experienced by a radio frequency signal incident upon a first surface of said radome structure before emerging from a second surface of said radome structure, said transmission frequency response including a first resonance region having a center frequency at a first frequency value and a second resonance region having a center frequency at a second frequency value that is different from said first frequency value; and disposing a conductive frequency selective surface (FSS) upon a first portion of said radome structure, said disposing step causing said center frequency of said second resonance region to shift from said second frequency value to a third frequency value, said third frequency value being different from said second frequency value, wherein both said first and second resonance regions with said center frequencies at said first and third frequency values, respectively, are present after said disposing step.

2. A method, as claimed in claim 1, wherein:

said second resonance region having said center frequency at said second frequency value before said disposing step is not the lowest frequency resonance region and said first resonance region having said center frequency at said first frequency value is the lowest frequency resonance region.

3. The method, as claimed in claim 2, wherein:

said FSS is a low pass filter structure having a cut off frequency that is higher than a cutoff frequency of said lowest frequency resonance region.

4. A method, as claimed in claim 1, wherein:

said second resonance region is a frequency passband.

5. The method, as claimed in claim 1, wherein said step of disposing a FSS includes the substeps of:

forming a metallic layer upon said first surface of said radome structure; and etching said metallic layer to form a periodic metallic pattern on said first surface.

6. The method, as claimed in claim 1, wherein:

said method is for use in retrofitting an existing radome unit.

7. The method, as claimed in claim 1, wherein:

said method is for use during original radome manufacture.

8. The method, as claimed in claim 1, wherein:

said radome structure is a monolithic radome structure.

9. The method, as claimed in claim 1, wherein:

said radome structure is a multi-layer structure.

10. The method, as claimed in claim 1, further comprising the step of:

ascertaining, before said step of disposing, a FSS pattern that will provide a necessary reactance to said radome structure to shift said center frequency of said second resonance region to said third frequency value.

11. A method for tuning a radome, comprising:

providing a radome structure having at least one layer of dielectric material, said radome structure having a transmission frequency response that describes, as a function of frequency, a level of attenuation experienced by a radio frequency signal incident upon a first surface of said radome structure before emerging from a second surface of said radome structure, said transmission frequency response including a first resonance region with a center frequency having a first frequency value and a second resonance region with a center frequency having a second frequency value, wherein said second frequency value is greater than said first frequency value;

determining that said second resonance region is desirably centered at a center frequency having a third frequency value that is different from said second frequency value; and affixing a conductive frequency selective surface (FSS) to an outer portion of said radome structure, said FSS shifting said center frequency of said second resonance region from said second frequency value to said third frequency value, wherein said second resonance region has said center frequency at said second frequency value before said affixing step and has said center frequency at said third frequency value after said affixing step and in which said first resonance region has said center frequency at said first frequency value both before said affixing step and after said affixing step.

12. The method, as claimed in claim 11, wherein:

said FSS is a low pass filter structure having a cutoff frequency that is greater than said first frequency value.

13. The method, as claimed in 11, wherein:

said FSS is a low pass filter structure having a cuttoff frequency that is between said first frequency value and said second frequency value.

14. The method, as claimed in claim 11, wherein:

said FSS is a low pass filter structure having a cutoff frequency that is greater than said second frequency value.

15. The method, as claimed in claim 11, wherein:

said FSS is a low pass filter structure that is substantially transparent at said first frequency value.

16. The method, as claimed in claim 11, further comprising the step of:

ascertaining, before said step of affixing, a FSS pattern that will provide a necessary reactance to said radome structure to shift said center frequency of said second resonance region to said third frequency value.

17. The method, as claimed in claim 11, wherein:

said first and second resonance regions are each passbands of said transmission frequency response.

18. A method for making a radome, comprising the steps of:

providing a dielectric structure having at least one layer of dielectric material, said dielectric structure having a transmission frequency response that describes, as a function of frequency, a level of attenuation experienced by a radio frequency signal incident upon a first surface of said dielectric structure before emerging from a second surface of said dielectric structure, wherein said transmission frequency response includes a first resonance region having a center frequency at a first frequency value and a second resonance region having a center frequency at a second frequency value and in which said second frequency value is a multiple of said first frequency value; and tuning said dielectric structure by depositing a periodic conductive pattern on at least one of said first surface and said second surface to change an impedance value of said dielectric structure, wherein said center frequency of said second resonance region shifts from said second frequency value to a different frequency value and in which said different frequency value is different from any multiple of said first frequency value and in which said first resonance region having said center frequency at said first frequency value remains after said tuning step.

19. The method, as claimed n claim 18, wherein:

said step of tuning includes determining a conductive frequency selective surface (FSS) pattern that will provide a necessary reactance value to said dielectric structure to shift said center frequency of said second resonance region to said different frequency value.

20. The method, as claimed in claim 19, wherein:

said step of determining a conductive frequency selective surface (FSS) pattern includes performing a mathematical calculation using the method of moments.

21. A method for making a radome, comprising the steps of:

providing a dielectric structure including at least one layer of dielectric material having a first surface and a second surface, said dielectric structure having a first transmission frequency response describing transmission of a radio frequency signal through said dielectric structure from said first surface to said second surface as a function of frequency, said first transmission frequency response including a first plurality of resonances including a first resonance and a second resonance, each of said first plurality of resonances have a center frequency;

defining a conductive frequency selective surface (FSS) pattern, said conductive FSS pattern having a lowpass frequency response that provides relatively low attenuation at frequencies below a first frequency and relatively high attenuation at frequencies above a second frequency, wherein said first frequency is no greater than said second frequency; and depositing said conductive FSS pattern on said dielectric structure to produce a composite structure said FSS shifting a center frequency of said second of said first plurality of resonances from an original value to a new value, wherein said composite structure includes a second transmission frequency response having a resonance centered at said new value and having a resonance centered at a first frequency value of said first resonance of said first plurality of resonances but no resonance centered at said original value of said second resonance of said first plurality of resonances.

22. The method, as claimed in claim 21, wherein:

said step of defining said conductive FSS includes determining a FSS pattern having a reactance necessary for shifting said center frequency of said second resonance of said first plurality of resonances in a predetermined manner.

23. The method, as claimed in claim 22, wherein:

said second resonance of said first plurality of resonances does not include a lowest frequency resonance of said first plurality of resonances.

24. The method, as claimed in claim 23, wherein:

said conductive FSS pattern is substantially transparent at a center frequency of said lowest frequency resonance.

25. A radome comprising:

a dielectric structure having at least one layer of dielectric material; and a conductive frequency selective surface (FSS) pattern deposited on said dielectric structure, said conductive FSS pattern having a lowpass frequency response, said dielectric structure and said conductive FSS pattern forming a composite structure;

wherein said composite structure has a transmission frequency response including a first resonance region with a center frequency having a first frequency value and a second resonance region with a center frequency having a second frequency value, said second frequency value being greater than said first frequency value and said second frequency value being different from a multiple of said first frequency value, wherein said second resonance region having said center frequency at said second frequency value is present after said conductive FSS pattern is deposited on said dielectric structure and is absent before said conductive FSS pattern is deposited on said dielectric structure and in which said first resonance region is present both with said dielectric structure and with said composite structure.

26. The radome as claimed in claim 25, wherein:

said lowpass frequency response of said conductive FSS pattern includes a cutoff frequency having a value that is greater than said first frequency value.

27. The radome as claimed in claim 25, wherein:

said conductive FSS pattern is modulated to enhance radome performance for an incoming electromagnetic signal at a predetermined angle of incidence.

28. The radome as claimed in claim 25, wherein:

said conductive FSS pattern rejects incoming electromagnetic waves having a predetermined polarization.

* * * * *